US006338442B1

(12) United States Patent
De Laforcade

(10) Patent No.: US 6,338,442 B1
(45) Date of Patent: Jan. 15, 2002

(54) DISPENSER FOR DISPENSING A PRODUCT

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/523,377

(22) Filed: Mar. 10, 2000

(30) Foreign Application Priority Data

Mar. 10, 1999 (FR) ..... 99 02962

(51) Int. Cl.[7] ..... B05B 7/32

(52) U.S. Cl. ..... 239/337; 222/402.21; 222/402.22; 222/402.24

(58) Field of Search ..... 239/333, 337, 239/463, 464, 302; 222/402.1, 402.13, 402.15, 402.21, 402.22, 402.24; 251/349, 354

(56) References Cited

U.S. PATENT DOCUMENTS 3,584,789 A 6/1971 Traynor
3,650,438 A 3/1972 Stephenson et al.
4,671,436 A 6/1987 Hagan
4,967,964 A * 11/1990 Pamper ..... 239/464
5,305,930 A 4/1994 De Laforcade
5,725,155 A * 3/1998 Grunenberg et al. ..... 239/337

* cited by examiner

*Primary Examiner*—Lisa Ann Douglas
(74) *Attorney, Agent, or Firm*—Finnegan, Henderson, Farabow, Garrett & Dunner, L.L.P.

(57) ABSTRACT

A dispenser for containing a product stored under pressure, for example a cosmetic product, and dispensing it, is provided. The dispenser includes a container containing a pressurized product with a valve. The valve includes a valve body, an inlet orifice and an outlet orifice, and a closure member for selectively placing inlet orifice in flow communication with the outlet orifice to cause the product to be dispensed through at least one dispensing orifice, in response to actuation of the closure member. The valve body is located outside the container. The communication between the inlet orifice and the outlet orifice is caused by pressure exerted on the closure member.

47 Claims, 4 Drawing Sheets

DISPENSER FOR DISPENSING A PRODUCT

Figure 1A:
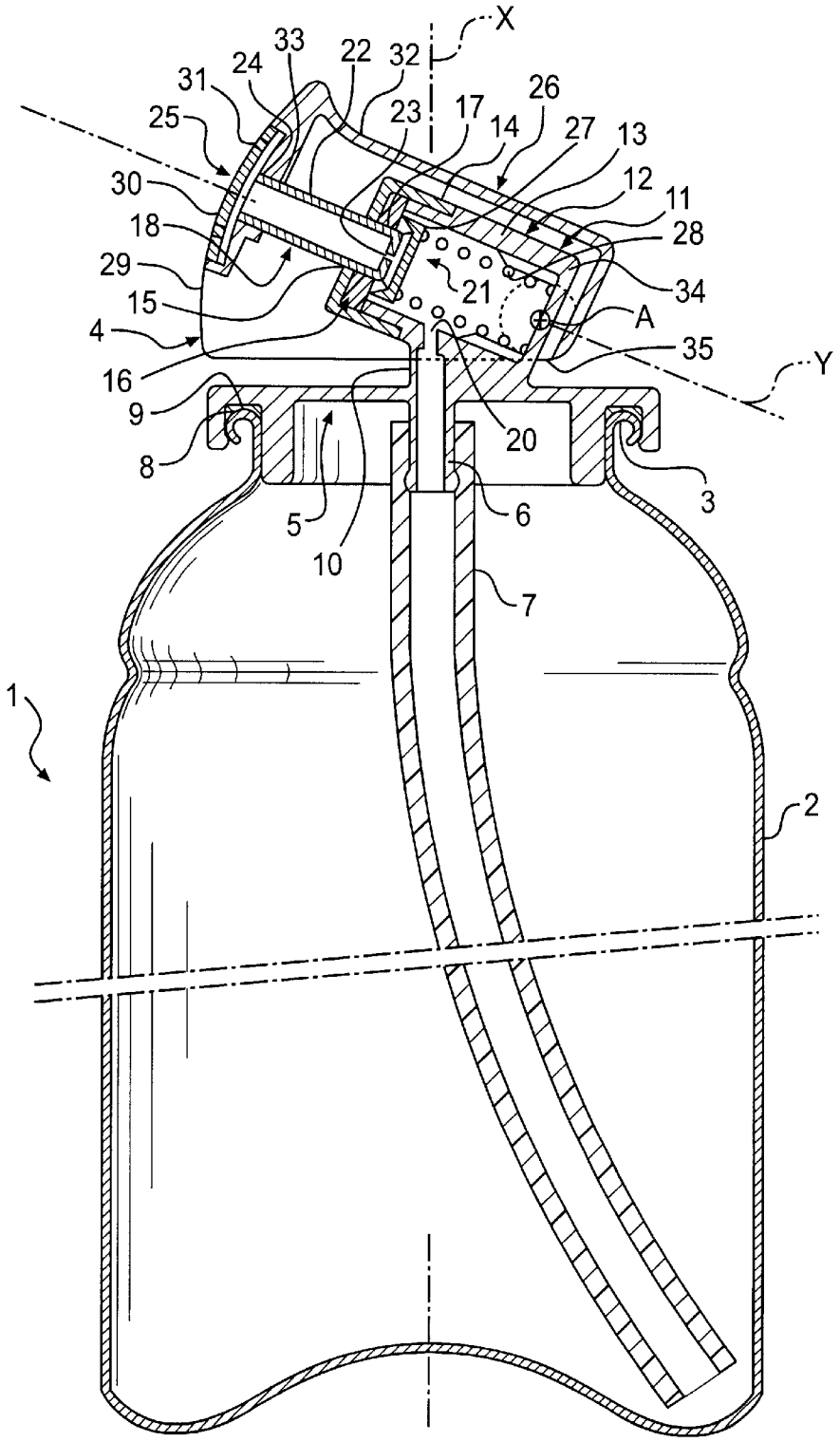

The present invention relates to a dispenser for containing a product stored under pressure, for example a cosmetic product, and dispensing it. A product of this kind may, in particular, be in the form of, for example, a mousse or foam, a gel or a spray, for hair styling. The product may be pressurized in the container using a propellant gas which may or may not be dissolved in the product, or by means of a piston which may itself exert pressure on the product by means of compressed air.

Typically, a device of this type comprises a container containing the product under pressure. The container is equipped with a valve of the type comprising a valve body having an inlet orifice and an outlet orifice, a closure member which in response to an actuating command causes the inlet orifice to be placed in communication with the outlet orifice allowing product to be let out via at least one dispensing orifice, and a spring element for forcing the closure member into a closed position in the absence of any actuating command. The valve body is arranged inside the container to which it is secured via a valve-holder dish crimped onto a rolled-over edge of the can which is generally made of metal. In its most common form, a valve of this kind comprises a valve stem which emerges from the valve body and on which is mounted a push-button capable of allowing the valve to be actuated. Because accessibility to the dispensing orifice has to be good enough for the product to be dispensed at the desired location, the valve body being completely contained within the container means the push-button has to be designed with relatively long ducts which convey the product to the dispensing orifice which is provided, for example, on a lateral skirt of the push-button.

One of the problems associated with a design of this kind stems from the fact that when the valve is open, the ducts fill with product contained in the can, such a product being, for example, in the case of a mousse or foam, formed of a mixture of a liquid formulation, surfactants, and gas which is partially dissolved and partially in vapor form. In practice, the mousse or foam develops as it leaves the device, that is to say at the point where the user collects it.

When the user releases the pressure on the push-button, the seal is reestablished at the valve closure system and this interrupts the dispensing operation. However, at that instant there is still within the ducts a not insignificant amount of product which is not yet expanded into the form of a mousse or foam. Gradually, the dissolved gas turns into vapor and a residual mousse or foam formed at the outlet from the push-button, foams away gently, and is not collected by the user. This foaming may occur over a period of several hours. Thus, when the user wishes to use this product again, the push-button, and possibly the cap, will be soiled with the foam and this detracts from the appearance and sometimes even from the correct operation of the device.

Attempts have been made to solve this problem by closing off the product-dispensing orifice using a needle which, in the closed position, is forced to bear in leakproof fashion against the dispensing orifice. Such needles are used in particular in manually operated pump devices, in which case the needle is forced into the closed position when the pump itself returns to the closed position, for example under the action of an biasing element.

A needle-type device of this kind is described, in combination with a valve, in U.S. Pat. No. 3,584,789 in which some of the alternative embodiments envisage forming the valve body inside the push-button and, in some cases, dispensing with the presence of a valve in the container.

Conventionally, the needle is moved into the open position by a tensile or pulling force exerted on the needle to cause it to withdraw from the dispensing orifice to open the orifice. In certain embodiments the tensile force is produced by pressing on a pressing surface, connected to the needle via a pivot, converting the pressing force on the pressing surface into a tensile force on the needle. In one particular embodiment the needle is stationary and therefore experiences no force, while the dispensing orifice is itself moved to uncover an annular passage. According to one feature which is common to all the alternative forms described in that document, because of the tensile force exerted on the needle along the axis of the valve body (in a movement away from the outlet orifice) or because of the movement of the dispensing orifice away from the closed end of the valve body, it is necessary to have a connecting piece which passes through an end of the valve body and is connected, on the one hand, to the needle and, on the other hand, to an actuating surface, so as to cause the needle to move axially. A moving part of this kind, passing through the end of the valve body, means that this point requires dynamic sealing of the end of the valve body, something which is particularly complex to achieve because of the movement of the connecting piece. As a result of this, practice has shown that a system of this kind is almost impossible to produce under economically and industrially viable conditions.

U.S. Pat. No. 3,650,438 describes an assembly consisting of an aerosol container equipped with a valve arranged conventionally inside the container, and the outlet of which is connected via a flexible duct to a dispensing system which is also equipped with a valve of the kind used in the container (see reference number 31; FIGS. 3, 5 and 7 of U.S. Pat. No. 3650,438). The purpose of such an embodiment is to be able to dispense the product some distance from the container containing it. A configuration of this kind does not in any way solve the problems discussed with reference to the conventional devices.

Thus, one of the objects of the present invention is to provide a dispenser for dispensing a product, preferably a cosmetic product, wherein the dispenser completely or partially solves the problems mentioned above with reference to the conventional devices.

In particular, one of the objects of the invention is to provide a system for dispensing a product stored under pressure, in which the volume of product which can dry out undesirably between two uses is appreciably reduced.

Another object of the invention is to provide a system of this kind which is simple, reliable and economical to produce.

Yet another object of the invention is to produce a dispenser for dispensing a product stored under pressure by means of a valve located at least partially outside of the container storing the product, and in which sealing is no more complicated to achieve than it is in the case of a traditional valve contained in the container.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a dispenser. According to the invention, the dispenser includes a container containing the product under pressure and equipped with a valve of the type comprising a valve body, the valve being mounted fixedly on the container and exhibiting an inlet orifice and an outlet orifice, a closure member being provided for causing the inlet orifice to be placed selectively in communication with the outlet orifice and for causing product to be let out via at least one dispensing orifice in response to an actuating command, a biasing element being provided for forcing the closure member into a closed position in the absence of any actuating command, the valve body being located outside the container, and the communication between the inlet orifice and the outlet orifice being caused by pressure exerted on the closure member.

Thus, the valve body, located outside the container, allows the product-despensing orifice to be positioned just at the outlet from the valve stem, in the case of a male valve, thus making it possible to dispense with the presence of auxiliary ducts formed by the actuating member. In the case of a female valve, the length of the ducts formed in the actuating member is also considerably reduced. Typically, the length needed approximately corresponds to the length of the valve stem in the case of a male valve.

The fact that the valve can be opened by a positive pressure exerted on the closure member, either axially with respect to the valve body or transversely to the valve body, preferably means that no sealing has to be provided other than the sealing necessary for closing the valve. In particular, and unlike U.S. Pat. No. 3,584,789, there is no dynamic sealing resulting, in particular, from the sliding of a connecting piece through an end of the valve body.

The dispenser may be of the type which works head down or head up, and in the instance where the head is up, the valve is secured to a dip tube, a free end of which ends more or less in the bottom of the container. The container may be made of metal or plastic, particularly based on a PET/PEN mixture. The dispenser may, in the storage position, be covered by a removable cap.

Advantageously, actuation is exerted on an actuating member bearing at least one dispensing orifice. Thus, as mentioned earlier, the fact that the valve body is located outside the container makes it easier to configure such an actuating member so that no duct is likely to hold product liable to dry out between two uses. With the dispenser according to the present invention, the dispensing orifice(s) may be formed at the outlet of the valve stem, that is to say, adjacent to the free end of the valve stem. In the case of a female valve, it is possible to restrict the length of duct to a length which is similar to the length of an emerging stem.

Advantageously, the closure member includes an annular ridge which, when the valve is in the closed position, is forced to bear in leakproof fashion against a seal member. The ridge at least partially ceases to bear against the seal member in response to actuation of the closure member.

In the case of a valve that has to be depressed, the closure member moves axially, interrupting the seal between the annular ridge and the seal member. In the case of a tilt valve, interruption occurs only over an angular sector, that is, only a portion of the annular ridge need move away from the seal member.

In one preferred embodiment, the valve is of the type that has to be depressed and the pressure exerted on the closure member is along an axis of the valve body, in the opposite direction to the return force exerted by the biasing element. When this is the case, the actuating member is articulated with respect to the container about an axis of rotation preferably approximately perpendicular to the axis of the container, the axis of rotation preferably being located near an one end of the actuating member distant from a closed end of the valve body.

According to another preferred embodiment, the valve is of the tilt type and the pressure is exerted on the closure member transversely to a longitudinal axis of the valve body. When this is the case, the actuating member is connected to a stationary part of the container, for example the valve body, and is articulatable about an axis of rotation preferably approximately perpendicular to the longitudinal axis of the container, the axis being advantageously located near a closed end of the valve body. An axis of rotation of this kind may be formed by a film hinge connecting the actuating member to a band mounted fixedly on the container. Alternatively, the valve body forms two lugs which are aligned along the axis and which are intended to be housed in corresponding recesses made in the actuating member, or vice versa.

As a preference, the valve is of the male type and includes a stem emerging from the valve body, the stem exhibiting a free end arranged so that it is adjacent to the at least one dispensing orifice. However, in an alternative, the valve may be of the female type.

According to a preferred embodiment, the valve body exhibits a longitudinal axis forming a non-zero angle with the axis of the container. Advantageously, the longitudinal axis of the valve body forms an angle of from 20° to 90° with respect to an axis of the container. When this angle is from 20° to 70°, and preferably from 30° to 60°, and when the dispensing is along the axis of the valve body, a device is produced in which the product is let out approximately laterally with respect to the container. With an angle of from 50° to 90°, the product outlet is approximately along the axis of the container, which is favorable to head-down use of the device.

The dispensing orifice(s) may be formed in a nozzle for example a nozzle with a swirl effect or a grating. In addition, the nozzle could be formed at least partially of a sintered material, for example, a thermoplastic or ceramic, or an opencell or semi-open-cell foam.

The device according to the invention may be used for packaging and dispensing a product, for example in the form of a mousse or foam, a gel or a liquid spray. In one preferred embodiment, the container contains a cosmetic product.

According to one aspect of the invention, a dispenser is provided. The dispenser includes a container containing the product, the product in the container being pressurized and a valve including a valve body located outside of the container, the valve being mounted fixedly on the container and including an inlet orifice and an outlet orifice, a closure member selectively moveable from a closed position to an open position in response to actuation of the valve caused by pressure exerted on the closure member, wherein when the closure member is in the open position, the inlet orifice is placed in flow communication with the outlet orifice to cause the product to exit the dispenser, and a biasing element for biasing the closure member into the closed position in the absence of the actuation of the valve.

According to another aspect of the invention, the valve includes an open end and a closed end of the valve body.

According to yet another aspect of the invention, the dispenser includes a dispensing head having at least one dispensing orifice, an actuating member, and a valve having a valve body, the valve being mounted fixedly on the container and including an inlet orifice and an outlet orifice, a closure member selectively moveable from a closed position to an open position in response to actuation of the actuating member caused by force exerted on the actuating member, wherein the actuating member is configured so that the actuation includes pivoting the actuating member with respect to the container about an axis of rotation perpendicular to a longitudinal axis of the container, the axis of rotation being located near an end of the actuating member distant from a closed end of the valve body, and wherein when the closure member is in the open position, the inlet orifice is placed in flow communication with the outlet orifice to cause the product to exit the dispenser through the at least one dispensing orifice.

According to a further embodiment of the invention, the dispenser includes a dispensing head including at least one dispensing orifice, an actuating member, and a valve having a valve body, the valve being mounted fixedly on the container and including an inlet orifice and an outlet orifice, a closure member selectively moveable from a closed position to an open position in response to actuation of the actuating member caused by force exerted on the dispenser head, wherein the dispenser head is configured so that the actuation includes tilting the dispenser head with respect to the container, and wherein when the closure member is in the open position, the inlet orifice is placed in flow communication with the outlet orifice to cause the product to exit the dispenser through the at least one dispensing orifice.

Beside the structural arrangements set forth above, the invention could include a number of other arrangements, such as those explained hereinafter. It is to be understood that both the foregoing description and the following description are exemplary, and are intended to provide further explanation of the invention as claimed.

Figure 1B:
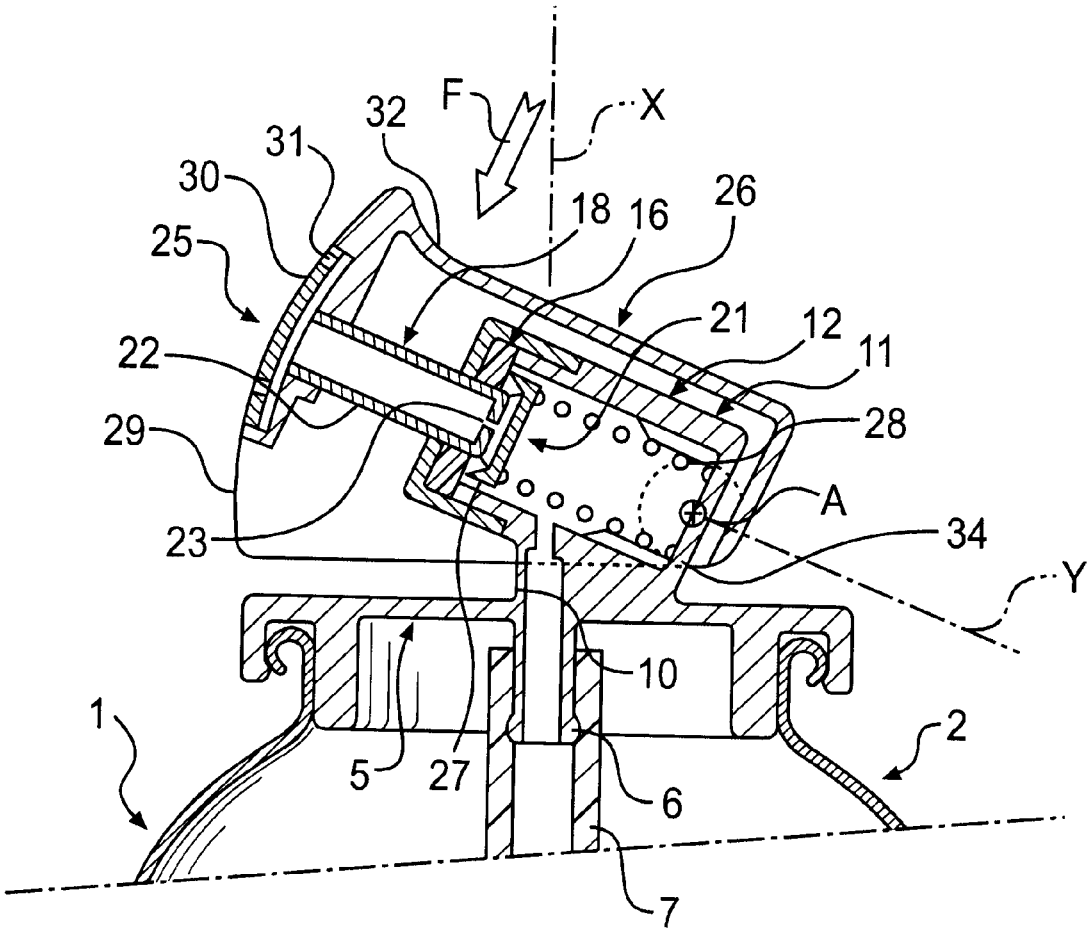
Figure 2A:
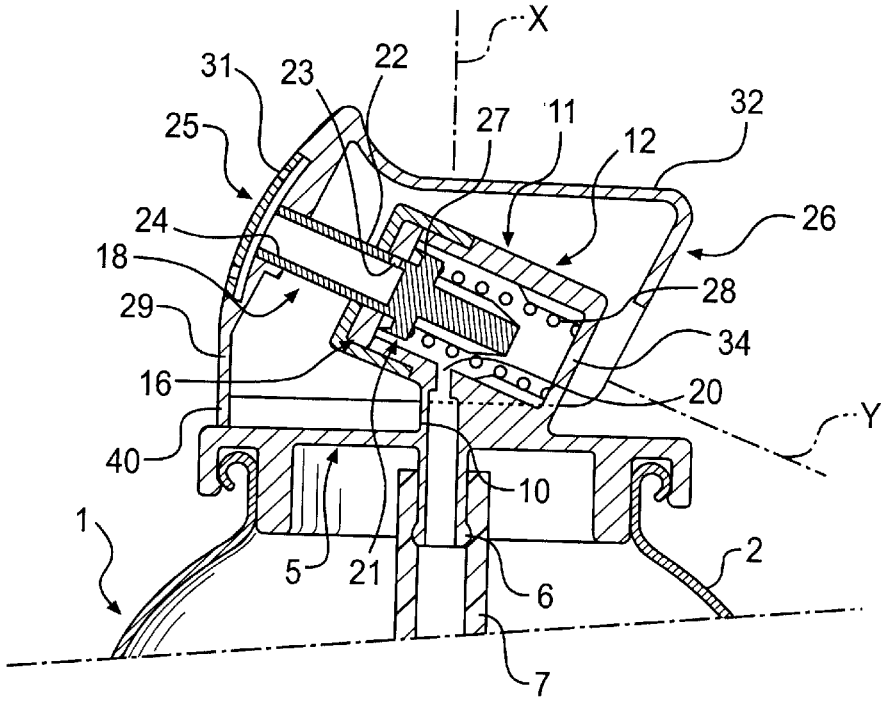
Figure 2B:
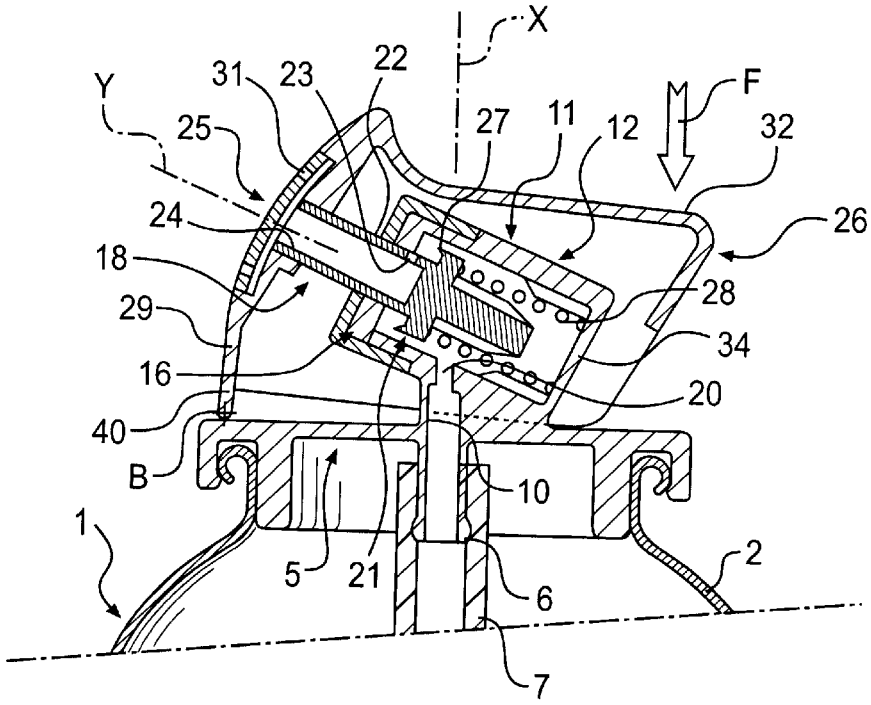
Figure 3A:
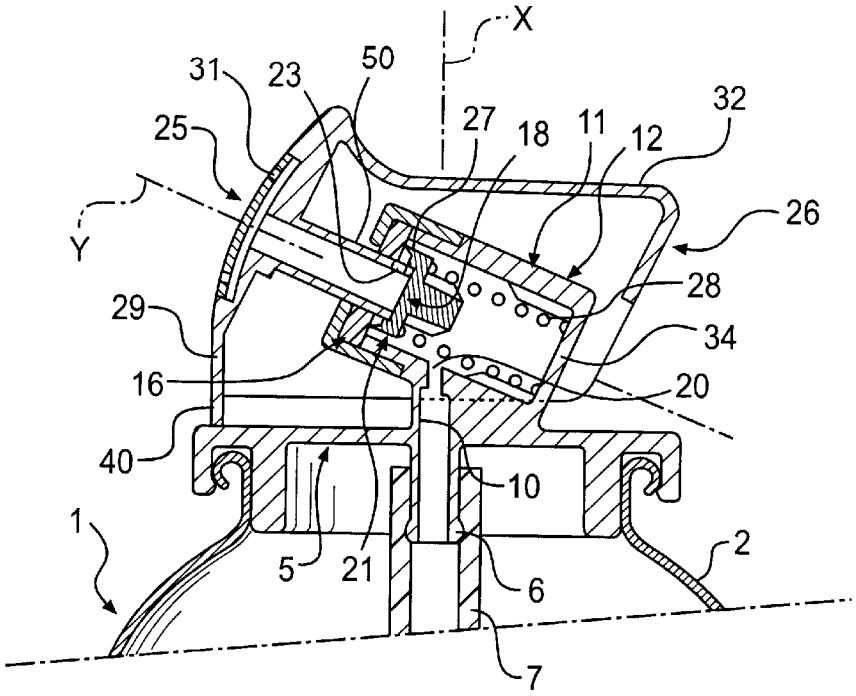
Figure 3B:
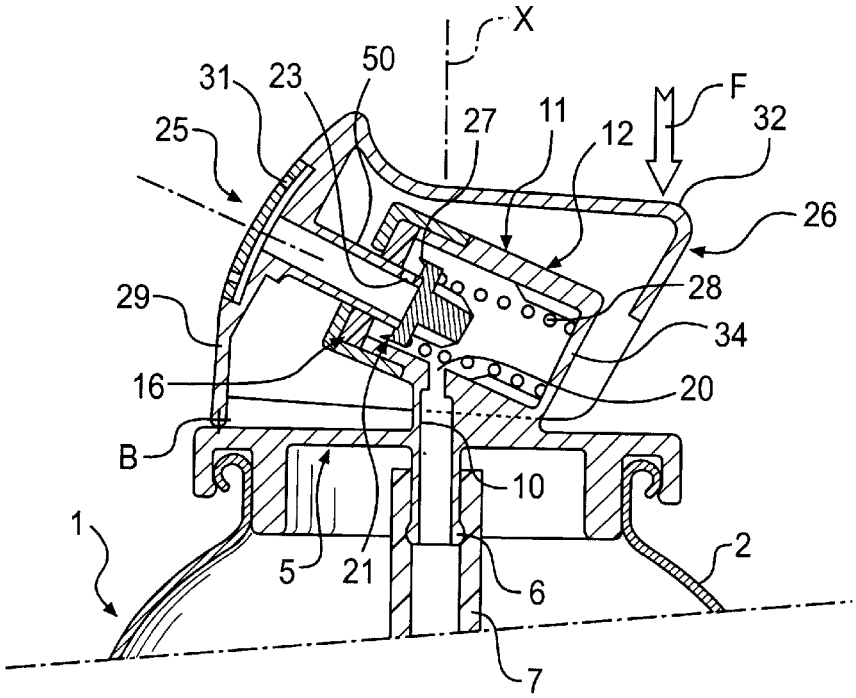

The accompanying drawings are included to provide a further understanding of the invention and are incorporated in and constitute a part of this specification. The drawings illustrate embodiments of the invention and, together with the description, serve to explain the principles of the invention. In the drawings, FIGS. 1A–1B are cross-sectional views of a first embodiment of the dispensing device according to the present invention;

FIGS. 2A–2B are cross-sectional views of a second embodiment of the dispensing device according to the present invention; and FIGS. 3A–3B are cross-sectional views of a third embodiment of the dispensing device according to the invention.

Reference will now be made in detail to the present preferred embodiments of the invention, examples of which are illustrated in the accompanying drawings. Wherever possible, the same reference numbers are used in the drawings and the description to refer to the same or like parts.

The dispenser of the present invention may be used for packaging and dispensing a product, for example, a cosmetic product such as a mousse or foam, a gel, or a liquid spray. The dispenser may be of the type which works head down or head up, and in the instance where the head is up the valve is preferably secured to a dip tube, a free end of which ends more or less in the bottom of the container. The device may, in the storage position, be covered by a removable cap.

As embodied herein and shown in FIGS. 1A and 1B, a dispenser for dispensing products, preferably cosmetic products, that are stored under pressure is provided. The dispenser 1 includes a container 2 having a longitudinal axis X. The container 2 may be made of metal or plastic, particularly based on a PET/PEN mixture. Container 2 has a free edge in the shape of a neck 3 which delimits an opening on which a dispensing head 4 is mounted. The dispensing head 4 includes a mounting piece 5 intended for mounting and connecting the dispensing head 4 to the container 2. The mounting piece 5 is preferably formed as an essentially flat element with an axial tube 6 facing towards the inside of the container 2 when the mounting piece 5 is mounted on container 2. Axial tube 6 is intended for the mounting of a dip tube 7. At its periphery, the mounting piece 5 has an annular groove 8 for snap-fastening the dispensing head 4 onto the neck 3 of the container 2, a seal 9 making the assembly leakproof.

Dispensing head 4 includes a valve 12 disposed outside of container 2 and an actuating member 26 disposed outside of valve 12. Actuating member 26 is preferably a "push-button" actuator and preferably at least partially surrounds valve 12. According to this preferred embodiment, the valve 12 is of the tilt type, and positive pressure is exerted on the actuating member in a direction transverse to an axis of the valve body in order to actuate the valve.

Axial tube 6 extends through mounting piece 5, above container 2, into a portion 10 which opens into body 11 of a valve 12, via an orifice 20. The portion 10 opens approximately mid-way up the axial height of the valve body 11. The valve body 11 has a longitudinal axis Y. The longitudinal axis Y and valve body 11 are orientated with respect to the longitudinal axis X of the container 2 to form an angle of between 20° and 90°. More preferably, the angle is between 20° and 70° or between 50° and 90°, and an even more preferred range is between 30° and 60° with 55° being the most preferred angle. When this angle is from 20° to 70°, and preferably from 30° to 60° with the dispensing orifice(s) oriented along the axis of the valve body 11, a dispenser is produced in which the product is released approximately laterally with respect to the container 2. With an angle of from 50° to 90°, the product outlet is approximately along the axis of the container, which is favorable to head-down use of the device.

The valve body 11 includes two parts, the actual body shell 13, one end of which is closed by a closed end wall 34, and a lid 14, which closes the valve body 11. The lid 14 is preferably mounted on the actual body shell 13 by welding, particularly ultrasound welding. The lid 14 has an orifice 15 centered on the longitudinal axis Y. Inside the valve body 11, pressed against the lid 14, is a seal member 16 which has an orifice 17 aligned with the orifice 15 in the lid 14. The seal member 16 is held in place against lid 14 by a free edge of the actual body shell 13.

Mounted slidably in the orifices 15 and 17 is a valve stem 18. Valve stem 18 is preferably formed as a single piece, and includes two main portions: a valve closure member 21 and a hollow stem 22 extending from the valve body 11, one end of which is closed by an end wall pierced at its center with an orifice 23, forming the outlet orifice of the valve body 11.

The closure member 21 includes a sharp annular ridge 27 capable of coming into leakproof engagement against the surface of the seal 16 so as to form a leakproof ring seal surrounding the outlet orifice 23. Closure member 21 forms such a leakproof seal under the elastic return force of a biasing element arranged inside the valve body 11, preferably a spring 28.Thus, the closure member 21 exhibits an annular ridge 27 which, when the valve 12 is in the closed position, is forced to bear in leakproof fashion against a seal member 16. The ridge at least partially ceases to bear in leakproof fashion against the seal member 16 in response to the pressure exerted on the closure member 21.

In the case of a tilt valve, as in this embodiment, interruption of the leakproof seal between the seal member 16 and the annular ridge 27 occurs only over an angular sector. That is, a portion of the annular ridge 27 may remain in contact with seal 16 when the valve is in the open position.

Valve stem 18 has a free end 24 arranged facing, and adjacent to, a nozzle or diffuser member 25, preferably in the form of a grating, and borne by actuating member 26 of the dispensing head 4. The dispensing member 25 may be, for example, a nozzle with a swirl effect or a grating. The dispensing member 25 may be made from, for example, a thermoplastic, a ceramic, an open-cell foam, or semiopen-cell foam.

The free end 24 of the valve stem 18 is push-fit into an axial passage 33 of the actuating member 26. Axial passage 33 opens into a depression made in a front face 29 of the actuating member 26 in which the diffuser member 25 is situated. The diffuser member 25 includes a solid central part 30 facing the free end 24 of the valve stem, and the solid central part 30 is surrounded by a substantially annular passage 31 in fluid communication with the valve stem 18. An appropriate connection is provided between the central part 30 and the outer portion of diffuser member 25.

In addition to diffuser member 25 in front surface 29 of the actuating member 26, actuating member 26 also includes a pressing surface 32 formed as a surface portion located at a front end of a top surface of the actuating member 26 and approximately perpendicular to the front surface 29 of the actuating member 26. At an end opposite to the diffusing member 25, the actuating member 26 is connected to the valve body 11 via two ball joints 35 or lugs borne by the actuating member 26, the two ball joints 35 capable of engaging with two corresponding recesses formed in the valve body 11. The actuating member 26 is articulatable about an axis of rotation A passing through the ball joints 35 and perpendicular to the longitudinal axes X and Y.

With the tilt-type valve used herein, the actuating member is connected to a stationary part of the container, for example the valve body 11, and is articulatable about an axis of rotation A which is preferably approximately perpendicular to the longitudinal axis X of the container. The axis of rotation A is preferably located near a closed end 34 of the valve body 11.

To use the dispenser 1 of the present invention, the user exerts a positive force or pressure by pushing on the pressing surface 32 (in the direction depicted by the arrow F in FIG. 1B), causing the actuating member 26 to tilt about the axis of rotation A. In so doing, the hollow stem 22 of the valve stem 18 experiences a force (pressure) from a direction transverse to the longitudinal axis Y of the valve 12 and towards the container 2. The same is true of closure member 21. Thus, over a given angular portion, the annular ridge 27 of closure member 21 is no longer in leakproof engagement with the seal member 16. The pressurized product contained in the valve body 11 thus rushes in between the annular ring 27 and the seal member 16, passes into the outlet orifice 23 of valve stem 18 and rises up the hollow stem 22 of the valve stem 18. At that moment, the product is deflected by the central part 30 of the grating 25 and leaves via the annular passage 31 in the front surface 29 of the actuating member 26 of the dispensing head 4. At that time, it can be collected by the user, particularly in the form of a foam or mousse. By releasing the pressure on the pressing surface 32, the leakproof seal between the closure member 21 and the seal member 16 is reestablished. The dispensing of product is interrupted. Only the product contained in the hollow stem 22 of the valve stem 18 which has not been dispensed remains at atmospheric pressure. Such a volume is very small. By way of example, this is a volume which may be of the order of 5 $mm^3$ or even less.

The fact that the valve can be opened by a positive pressure exerted on the closure transversely to the valve body means that preferably no sealing has to be provided other than the sealing necessary for closing the valve (i.e., preferably no sealing of the closed end of the valve is required). In particular, and unlike prior art devices, there is preferably no dynamic sealing resulting from the sliding of a connecting piece in the closed end of the valve body.

The embodiment of FIGS. 2A and 2B is an alternative form of the one discussed above with respect to FIGS. 1A and 1B. In this embodiment, the valve is of the type that has to be depressed and the pressure is exerted on the closure member along an axis of the valve body, in a direction opposite to the return force exerted by the biasing element. Thus, in the instant case, the actuating member 26 is articulated with respect to the container about an axis of rotation B which is preferably approximately perpendicular to the longitudinal axis X of the container. Axis of rotation B is preferably located near the end of the actuating member 26 distant from a closed end of the valve body. This embodiment differs from the previous one mainly in that the valve 12 is of the type that has to be depressed, not tilted. Opening such a valve requires a pressing force directed approximately along the axis of the valve stem 18, against the elastic return force exerted by the spring 28. With such a force thus exerted, it is the entire annular ridge 27 which ceases to be in leakproof engagement with the seal member 16, and thus the entire leakproof seal is interrupted, rather than just a portion thereof.

As embodied in FIGS. 2A and 2B, the outlet orifice 23 includes an orifice formed radially at the base of the valve stem 18. In the closed position illustrated in FIG. 2A, the orifice 23 is facing the seal member 16, thus improving the tightness of the seal achieved between the annular ridge 27 and the sealing member 16. In the open position illustrated in FIG. 2B, the orifice 23 is axially offset from the seal member 16 so that the product passing under the annular ridge 27 enters the valve stem 18 via the orifice 23.

As embodied herein and shown in FIGS. 2A and 2B, use of a valve to be depressed requires that the pressing surface 32 of actuating member 26 is formed of a surface portion located at the rear of the top surface of the actuating member 26 (as opposed to the front end) and is approximately perpendicular to the longitudinal axis X of the container 2. A lower edge of the front face 29 of the actuating member 26 includes a portion 40 which abuts against the mounting piece 5. Thus, by exerting a positive force or pressure by pushing on the pressing surface 32, in the direction illustrated by the arrow F in FIG. 2B, the actuating member is tilted about an axis of rotation B which is approximately coincident with the portion 40. The actuating member 26 will continue to tilt in this way until the rear of the actuating member 26 abuts against a corresponding part of the mounting piece 5. Through this process, a force is exerted on the valve stem 18 approximately along the longitudinal axis Y of the valve body and in a direction opposite to the return force of the spring 28. This force causes the closure member 21 to move away from seal member 16 and thus interrupts the leakproof seal at the annular ridge 27. The product enters the valve stem 18 via the radial passage 23 and is dispensed in the same way as it was in the previous embodiment.

The embodiment of FIGS. 3A–3B represents an alternative form of the dispenser discussed with respect to FIGS. 2A and 2B. As was the case in the previous embodiment, the valve of the instant embodiment is preferably a valve that is depressed in order to be opened. However, in this embodiment, the valve is of the female type. Thus, there are some differences between the embodiment set forth with respect to FIGS. 2A and 2B and the present embodiment as discussed below.

As embodied herein and shown in FIGS. 3A and 3B, the actuating member 26 includes a duct 50 facing the diffusing grating 25, the duct 50 having a free end intended to abut against the closure member 21 of the valve stem 18 inside the valve body. Force exerted along the longitudinal axis Y of the valve body, in a direction opposite to the return force exerted by the spring 28, causes the valve to open in a similar way to the opening of the valve in the previous embodiment. The dimensional characteristics of the duct 50 are similar to those of hollow stem 22 of the valve stem 18 in the previous embodiments. The way in which this embodiment works, particularly in terms of the pressing force to be exerted for opening the valve, and in terms of the movement of the actuating member 26 in response to this force, is identical to what was described in the previous embodiment.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A dispenser for dispensing a product, the dispenser comprising:

a container containing the product, the product in the container being pressurized, and a valve including a valve body located outside of the container, said valve being rigidly mounted on the container and including:

an inlet orifice and an outlet orifice, a closure member selectively moveable from a closed position to an open position in response to actuation of the valve caused by pressure exerted on the closure member, wherein when the closure member is in the open position, the inlet orifice is placed in flow communication with the outlet orifice to cause the product to exit the dispenser, and a biasing element for biasing the closure member into the closed position in the absence of said actuation of the valve.

2. The dispenser of claim 1, further comprising an actuating member having at least one dispensing orifice through which the product exits the dispenser, said actuation of the valve including pressing of the actuating member.

3. The dispenser of claim 1, wherein the closure member includes an annular ridge cooperating with a seal member to form a leakproof seal when the closure member of the valve is in the closed position.

4. The dispenser of claim 3, wherein the valve is configured such that the leakproof seal between the annular ridge and the seal member is at least partially released in response to said actuation.

5. The dispenser of claim 2, wherein the valve is configured so that said actuation causes pressure to be exerted on the closure member along a longitudinal axis of the valve body and in a direction opposite to a return force exerted by the biasing element.

6. The dispenser of claim 5, wherein the valve is configured so that said actuation includes pivoting the actuating member with respect to the container about an axis of rotation perpendicular to a longitudinal axis of the container, said axis of rotation being located near one end of the actuating member and away from a closed end of the valve body.

7. The dispenser of claim 1, wherein the valve is configured so that said actuation includes tilting the valve body with respect to the container, the tilting causing pressure to be exerted on the closure member transverse to a longitudinal axis of the valve body.

8. The dispenser of claim 2, wherein the valve is configured so that said actuation includes tilting the valve body with respect to the container about an axis of rotation perpendicular to a longitudinal axis of the container, said axis of rotation being located near a closed end of the valve body.

9. The dispenser of claim 1, further comprising a valve stem extending between a product dispensing orifice and the outlet orifice.

10. The dispenser of claim 1, wherein an angle formed between a longitudinal axis of the valve body and a longitudinal axis of the container ranges from 20 degrees to 90 degrees.

11. The dispenser of claim 10, wherein the angle ranges from 20 degrees to 70 degrees.

12. The dispenser of claim 11, wherein the angle ranges from 30 degrees to 60 degrees.

13. The dispenser of claim 12, wherein the angle is 55 degrees.

14. The dispenser of claim 1, further comprising a nozzle including at least one dispensing orifice.

15. The dispenser of claim 14, wherein the nozzle is configured to dispense the product in a swirl effect.

16. The dispenser of claim 14, wherein the nozzle is configured as a grating.

17. The dispenser of claim 14, wherein the nozzle comprises one of a thermoplastic material, a ceramic material, an open-cell foam, and a semi-open-cell foam.

18. The dispenser of claim 1, wherein the product is a cosmetic product.

19. The dispenser of claim 1, wherein the biasing element is a spring.

20. A dispenser for dispensing a product, the dispenser comprising:

a container containing the product, the product in the container being pressurized; and a female valve including a valve body located outside of the container, said valve being mounted fixedly on the container and including:

an inlet orifice and an outlet orifice, a closure member selectively moveable from a closed position to an open position in response to actuation of the valve caused by pressure exerted on the closure member, wherein when the closure member is in the open position, the inlet orifice is placed in flow communication with the outlet orifice to cause the product to exit the dispenser, and a biasing element for biasing the closure member into the closed position in the absence of said actuation of the valve.

21. A dispenser for dispensing a product, the dispenser comprising:

a container containing the product, the product in the container being pressurized; and a valve including a valve body located outside of the container, said valve being rigidly mounted on the container and including:

an inlet orifice and an outlet orifice, an open end and a closed end of the valve body, a closure member between the open end and the closed end of the valve body, the closure member being selectively moveable from a closed position to an open position in response to actuation of the valve caused by force exerted on the closure member, wherein when the closure member is in the open position, the inlet orifice is placed in flow communication with the outlet orifice to cause the product to exit the dispenser, and a biasing element for biasing the closure member into the closed position in the absence of said actuation of the valve.

22. The dispenser of claim 21, further comprising an actuating member having at least one dispensing orifice through which the product exits the dispenser, said actuation of the valve including pressing of the actuating member.

23. The dispenser of claim 21, wherein the closure member includes an annular ridge cooperating with a seal member to form a leakproof seal when the closure member of the valve is in the closed position.

24. The dispenser of claim 22, wherein the valve is configured so that said actuation causes force to be exerted on the closure member along a longitudinal axis of the valve body and in a direction opposite to a return force exerted by the biasing element.

25. The dispenser of claim 21, wherein an angle formed between a longitudinal axis of the valve body and a longitudinal axis of the container ranges from 20 degrees to 90 degrees.

26. The dispenser of claim 21, wherein the product is a cosmetic product.

27. The dispenser of claim 21, wherein the biasing element is a spring.

28. The dispenser of claim 21, further comprising a valve stem extending between a product dispensing orifice and the open end of the valve body.

29. A dispenser for dispensing a product, the dispenser comprising:

a container containing the product, the product in the container being pressurized;

a valve including a valve body located outside of the container, said valve being mounted fixedly on the container and including:

an inlet orifice and an outlet orifice, an open end and a closed end of the valve body, a closure member between the open end and the closed end of the valve body, the closure member being selectively moveable from a closed position to an open position in response to actuation of the valve caused by force exerted on the closure member, wherein when the closure member is in the open position, the inlet orifice is placed in flow communication with the outlet orifice to cause the product to exit the dispenser, and a biasing element for biasing the closure member into the closed position in the absence of said actuation of the valve; and an actuating member having at least one dispensing orifice through which the product exits the dispenser, said actuation of the valve including pressing of the actuating member, wherein the valve is configured so that said actuation causes force to be exerted on the closure member along a longitudinal axis of the valve body and in a direction opposite to a return force exerted by the biasing element and wherein the valve is configured so that said actuation includes pivoting the actuating member with respect to the container about an axis of rotation perpendicular to a longitudinal axis of the container, said axis of rotation being located near an end of the actuating member distant from the closed end of the valve body.

30. A dispenser for dispensing a product, the dispenser comprising:

a container containing the product, the product in the container being pressurized; and a valve including a valve body located outside of the container, said valve being mounted fixedly on the container and including:

an inlet orifice and an outlet orifice, an open end and a closed end of the valve body, a closure member between the open end and the closed end of the valve body, the closure member being selectively moveable from a closed position to an open position in response to actuation of the valve caused by force exerted on the closure member, wherein when the closure member is in the open position, the inlet orifice is placed in flow communication with the outlet orifice to cause the product to exit the dispenser, and a biasing element for biasing the closure member into the closed position in the absence of said actuation of the valve, wherein the valve is configured so that said actuation includes tilting the valve body with respect to the container, the tilting causing force to be exerted on the closure member transverse to a longitudinal axis of the valve body.

31. A dispenser for dispensing a product, the dispenser comprising:

a container containing the product, the product in the container being pressurized;

a valve including a valve body located outside of the container, said valve being mounted fixedly on the container and including:

an inlet orifice and an outlet orifice, an open end and a closed end of the valve body, a closure member between the open end and the closed end of the valve body, the closure member being selectively moveable from a closed position to an open position in response to actuation of the valve caused by force exerted on the closure member, wherein when the closure member is in the open position, the inlet orifice is placed in flow communication with the outlet orifice to cause the product to exit the dispenser, and a biasing element for biasing the closure member into the closed position in the absence of said actuation of the valve; and an actuating member having at least one dispensing orifice through which the product exits the dispenser, said actuation of the valve including pressing of the actuating member, wherein the valve is configured so that said actuation includes tilting the valve body with respect to the container about an axis of rotation perpendicular to a longitudinal axis of the container, said axis of rotation being located near the closed end of the valve body.

32. A dispenser for dispensing a product, the dispenser comprising:

a container containing the product, the product in the container being pressurized; and a dispensing head including at least one dispensing orifice, an actuating member, and a valve having a valve body, said valve being mounted fixedly on the container and including:

an inlet orifice and an outlet orifice, a closure member selectively moveable from a closed position to an open position in response to actuation of the actuating member caused by force exerted on the actuating member, wherein the actuating member is configured so that said actuation includes pivoting the actuating member with respect to the container about an axis of rotation perpendicular to a longitudinal axis of the container, said axis of rotation being located near an end of the actuating member distant from a closed end of the valve body, and wherein when the closure member is in the open position, the inlet orifice is placed in flow communication with the outlet orifice to cause the product to exit the dispenser through the at least one dispensing orifice, and a biasing element for biasing the closure member into the closed position in the absence of said actuation of the valve.

33. The dispenser of claim 32, wherein the dispensing head includes a valve stem extending between the at least one dispensing orifice and the closure member.

34. The dispenser of claim 32, wherein the biasing element includes a spring.

35. The dispenser of claim 32, wherein the closure member includes an annular ridge cooperating with a seal member to form a leakproof seal when the closure member of the valve is in the closed position.

36. The dispenser of claim 32, wherein an angle formed between a longitudinal axis of the valve body and a longitudinal axis of the container body ranges from 20 degrees to 90 degrees.

37. The dispenser of claim 32, wherein said actuation causes a force to be exerted on the closure member along a longitudinal axis of the valve body and in a direction opposite to a return force exerted by the biasing element.

38. The dispenser of claim 32, wherein the closure member is configured to tilt with respect to the valve body in response to a force exerted on the closure member in a direction transverse to the longitudinal axis of the valve body.

39. The dispenser of claim 32, wherein the product is a cosmetic product.

40. A dispenser for dispensing a product, the dispenser comprising:

a container containing the product, the product in the container being pressurized; and a dispensing head including at least one dispensing orifice, an actuating member, and a valve having a valve body, said valve being rigidly mounted on the container and including:

an inlet orifice and an outlet orifice, a closure member selectively moveable from a closed position to an open position in response to actuation of the actuating member caused by force exerted on the dispensing head, wherein the dispenser head is configured so that said actuation includes tilting at least a portion of the dispensing head with respect to the container, and wherein when the closure member is in the open position, the inlet orifice is placed in flow communication with the outlet orifice to cause the product to exit the dispenser through the at least one dispensing orifice, and a biasing element for biasing the closure member into the closed position in the absence of said actuation of the valve.

41. The dispenser of claim 40, wherein the dispensing head includes a valve stem extending between the at least one dispensing orifice and the closure member.

42. The dispenser of claim 40, wherein the biasing element includes a spring.

43. The dispenser of claim 40, wherein the closure member includes an annular ridge cooperating with a seal member to form a leakproof seal when the closure member is in the closed position.

44. The dispenser of claim 43, wherein the closure member is configured to move along a longitudinal axis of the valve and away from the seal member in response to said actuation.

45. A dispenser for dispensing a product, the dispenser comprising:

a container containing the product, the product in the container being pressurized; and a dispensing head including at least one dispensing orifice, an actuating member, and a valve having a valve body, said valve being mounted fixedly on the container and including:

an inlet orifice and an outlet orifice, a closure member selectively moveable from a closed position to an open position in response to actuation of the actuating member caused by force exerted on the dispenser head, wherein the dispenser head is configured so that said actuation includes tilting the dispenser head with respect to the container, and wherein when the closure member is in the open position, the inlet orifice is placed in flow communication with the outlet orifice to cause the product to exit the dispenser through the at least one dispensing orifice, and a biasing element for biasing the closure member into the closed position in the absence of said actuation of the valve, wherein the dispensing head is configured to tilt about an axis of rotation perpendicular to a longitudinal axis of the valve in response to said actuation.

46. A dispenser for dispensing a product, the dispenser comprising:

a container containing the product, the product in the container being pressurized; and a dispensing head including at least one dispensing orifice, an actuating member, and a valve having a valve body, said valve being mounted fixedly on the container and including:

an inlet orifice and an outlet orifice, a closure member selectively moveable from a closed position to an open position in response to actuation of the actuating member caused by force exerted on the dispenser head, wherein the dispenser head is configured so that said actuation includes tilting the dispenser head with respect to the container, and wherein when the closure member is in the open position, the inlet orifice is placed in flow communication with the outlet orifice to cause the product to exit the dispenser through the at least one dispensing orifice, and a biasing element for biasing the closure member into the closed position in the absence of said actuation of the valve, wherein the dispensing head is configured to tilt about an axis of rotation perpendicular to a longitudinal axis of the container in response to said actuation.

47. A dispenser for dispensing a product, the dispenser comprising:

a container having a longitudinal axis and containing the product, the product in the container being pressurized; and a valve having a longitudinal axis and including a valve body located outside of the container, said valve being rigidly mounted on the container and including a closure member selectively moveable from a closed position to an open position in response to actuation of the valve, wherein the longitudinal axis of the valve body is angled with respect to the longitudinal axis of the container, and wherein actuation of the valve causes pressure to be exerted on the closure member.

* * * * *